US011782369B2

(12) United States Patent
Nakano et al.

(10) Patent No.: US 11,782,369 B2
(45) Date of Patent: Oct. 10, 2023

(54) FIXING DEVICE AND IMAGE FORMING APPARATUS THEREWITH

(71) Applicant: KYOCERA Document Solutions Inc., Osaka (JP)

(72) Inventors: Kuniaki Nakano, Osaka (JP); Takashi Miyake, Osaka (JP); Kenichi Kasama, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/835,781

(22) Filed: Jun. 8, 2022

(65) Prior Publication Data

US 2022/0397849 A1 Dec. 15, 2022

(30) Foreign Application Priority Data

Jun. 14, 2021 (JP) ..... 2021-098656
Jun. 14, 2021 (JP) ..... 2021-098658
Jun. 14, 2021 (JP) ..... 2021-098660

(51) Int. Cl.
*G03G 15/20* (2006.01)

(52) U.S. Cl.
CPC ..... *G03G 15/2053* (2013.01); *G03G 15/205* (2013.01); *G03G 15/2028* (2013.01)

(58) Field of Classification Search
CPC ..... G03G 15/2028; G03G 15/2053; G03G 15/205
See application file for complete search history.

(56) References Cited

U.S. PATENT DOCUMENTS

2017/0299989 A1 10/2017 Nakano ..... G03G 15/2017

FOREIGN PATENT DOCUMENTS

JP 2017-194499 A 10/2017
JP 2018010164 A * 1/2018

OTHER PUBLICATIONS

JP_2018010164_A_I MachineTranslation, Japan, Furukawa, 2018.*

* cited by examiner

*Primary Examiner* — Victor Verbitsky
(74) *Attorney, Agent, or Firm* — Stein IP, LLC

(57) ABSTRACT

A fixing device includes a first fixing member, a second fixing member, a charging portion, and a control portion. The first fixing member makes contact with a toner image on a sheet conveyed along a conveying passage. The second fixing member forms a nip. The charging portion generates an application current. The control portion can perform an application mode, in which the application current is generated, and a standby mode, in which no application current is generated. The control portion performs the application mode during a first period after initial start-up until the passage of a predetermined period and performs the standby mode during a second period after the passage of the first period until the passage of a predetermined period.

16 Claims, 11 Drawing Sheets

FIXING DEVICE AND IMAGE FORMING APPARATUS THEREWITH

INCORPORATION BY REFERENCE

This application is based upon and claims the benefit of priority from the corresponding Japanese Patent Application No. 2021-098656 filed on Jun. 14, 2021, Japanese Patent Application No. 2021-098658 filed on Jun. 14, 2021, and Japanese Patent Application No. 2021-098660 filed on Jun. 14, 2021, the entire contents of which are hereby incorporated by reference.

BACKGROUND

The present disclosure relates to a fixing device, and to an image forming apparatus provided with a fixing device.

For the purpose of fixing a toner image to a sheet in image forming apparatuses, fixing devices are widely used which include a first fixing member such as a fixing roller or a fixing belt and a second fixing member such as a pressing roller. The first and second fixing members are kept in pressed contact with each other to form a fixing nip. With the outer circumferential face of the first fixing member heated to a predetermined temperature, a sheet such as a printing sheet is passed through the fixing nip. Here, the outer circumferential face of the first fixing member makes contact with the side of the sheet on which a toner image is formed. In this way, by heating and pressing a toner image formed on a sheet, the toner image is fused and fixed to the sheet.

In such fixing devices, when a sheet passes through the fixing nip, part of the toner in an unfixed toner image may electrostatically attach to the outer circumferential face of the first fixing member to be eventually transferred to the subsequent sheet, thus causing an image defect called an electrostatic offset. To suppress an electrostatic offset, some fixing devices include a charging portion.

The charging portion applies electric charge to the outer circumferential face of the first fixing member and to the surface of the sheet (the part of the side of the sheet that is to make contact with the outer circumferential face of the first fixing member but that has not made contact with the first fixing member yet). The charging portion includes a plurality of electrodes and applies a high voltage to between the electrodes to produce corona discharge (application current) so as to generate positive ions. Positive ions move to the sheet and to the outer circumferential face of the first fixing member so that the sheet and the outer circumferential face of the first fixing member become charged with electric charge of the same (positive) polarity. This makes the unfixed toner image on the sheet less likely to attach to the outer circumferential face of the first fixing member.

SUMMARY

According to one aspect of the present disclosure, a fixing device includes a first fixing member, a second fixing member, a charging portion, and a control portion. The first fixing member makes contact with a toner image on a sheet conveyed along a conveying passage. The second fixing member forms, between itself and the first fixing member, a nip through which the sheet passes. The charging portion generates an application current for applying electric charge so as to apply electric charge to a part of the outer circumferential face of the first fixing member on the upstream side of the nip in the moving direction of the outer circumferential face and to the toner image on the sheet. The control portion controls the charging portion. The control portion can perform an application mode, in which the application current is generated, and a standby mode, in which no application current is generated. The control portion performs the application mode during a first period after initial start-up until the passage of a predetermined period and performs the standby mode during a second period after the passage of the first period until the passage of a predetermined period.

DETAILED DESCRIPTION

Figure 1:
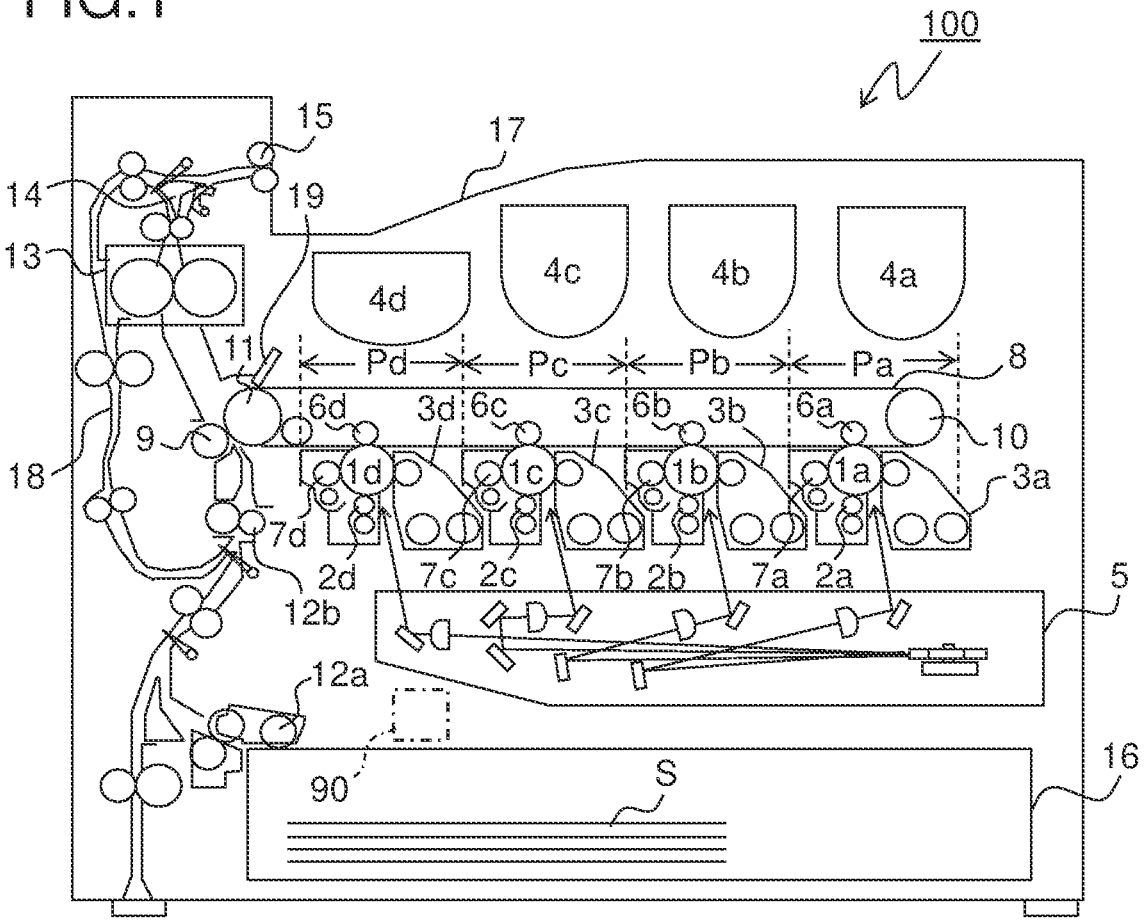
FIG. 1 is a schematic sectional view showing the internal structure of an image forming apparatus according to an embodiment of the present disclosure.

Hereinafter, with reference to the accompanying drawings, a first embodiment of the present disclosure will be described. FIG. 1 is a schematic sectional view showing the internal structure of an image forming apparatus 100 according to the first embodiment of the present disclosure. In the main body of the image forming apparatus 100 (here, a color printer), four image forming portions, Pa, Pb, Pc and Pd are arranged in this order from the upstream side in the conveying direction (from the right side in FIG. 1). These image forming portions Pa to Pd are provided so as to correspond to images of four different colors (cyan, magenta, yellow, and black) and sequentially form images of cyan, magenta, yellow, and black through the processes of electrostatic charging, exposure, developing, and transfer.

In these image forming portions Pa to Pd, photosensitive drums 1*a*, 1*b*, 1*c*, and 1*d* are respectively arranged which carry visible images (toner images) of the different colors. Furthermore, an intermediate transfer belt 8 which rotates clockwise in FIG. 1 is provided adjacent to the image forming portions Pa to Pd. The toner images formed on the photosensitive drums 1*a* to 1*d* are primarily transferred sequentially, while being superimposed on each other, to the intermediate transfer belt 8 that moves while keeping contact with the photosensitive drums 1*a* to 1*d*. Then, the toner images primarily transferred to the intermediate transfer belt 8 are secondarily transferred by a secondary transfer roller 9 to sheet S, which is one example of a recording medium. The sheet S on which the toner images have been secondarily transferred is, after having the toner images fixed on it in a fixing device 13, discharged out of the main body of the image forming apparatus 100. An image forming process is performed with respect to the photosensitive drums 1*a* to 1*d* while they are rotated by a main motor 40 (see FIG. 3) counter-clockwise in FIG. 1.

The sheet S to which the toner image is secondarily transferred is stored in a sheet cassette 16 arranged in a lower part of the main body of the image forming apparatus 100, and is conveyed via a sheet feeding roller 12*a* and a registration roller pair 12*b* to a nip between the secondary transfer roller 9 and a driving roller 11 of the intermediate transfer belt 8. Used as the intermediate transfer belt 8 is a sheet of dielectric resin, and typically is a belt with no seams (seamless belt). On the downstream side of the secondary transfer roller 9, a blade-form belt cleaner 19 is arranged for removing toner and the like left on the surface of the intermediate transfer belt 8.

Next, a description will be given of the image forming portions Pa to Pd. Around and below the photosensitive drums 1*a* to 1*d* that are rotatably arranged, there are provided charging devices 2*a*, 2*b*, 2*c*, and 2*d* which electrostatically charge the photosensitive drums 1*a* to 1*d* respectively, an exposure device 5 which exposes the photosensitive drums 1*a* to 1*d* to light carrying image information, developing devices 3*a*, 3*b*, 3*c*, and 3*d* which form toner images on the photosensitive drums 1*a* to 1*d* respectively, and cleaning devices 7*a*, 7*b*, 7*c*, and 7*d* which remove developer (toner) and the like left on the photosensitive drums 1*a* to 1*d* respectively.

When image data is input from a host device such as a personal computer, first, the surfaces of the photosensitive drums 1*a* to 1*d* are electrostatically charged uniformly by the charging devices 2*a* to 2*d*. Next, the exposure device 5 irradiates the photosensitive drums 1*a* to 1*d* with light based on the image data to form on them electrostatic latent images reflecting the image data. The developing devices 3*a* to 3*d* are loaded with predetermined amounts of two-component developer containing cyan, magenta, yellow, and black toner respectively. When, through formation of toner images, which will be described later, the proportion of toner in a two-component developer stored in the developing devices 3*a* to 3*d* falls below a determined value, toner is supplied from toner containers 4*a* to 4*d* to the developing devices 3*a* to 3*d* respectively. The toner in the developer is fed from the developing devices 3*a* to 3*d* to the photosensitive drums 1*a* to 1*d* respectively, and electrostatically attaches to them. In this way, toner images corresponding to the electrostatic latent images formed through exposure to light from the exposure device 5 are formed.

Then, by primary transfer rollers 6*a* to 6*d*, an electric field with a predetermined transfer voltage is applied between the primary transfer rollers 6*a* to 6*d* and the photosensitive drums 1*a* to 1*d*, and the cyan, magenta, yellow, and black toner images on the photosensitive drums 1*a* to 1*d* are primarily transferred to the intermediate transfer belt 8. These images of four colors are formed in a predetermined positional relationship with each other that is prescribed for formation of a predetermined full-color image. Then, in preparation for the subsequent formation of new electrostatic latent images, toner and the like left on the surface of the photosensitive drums 1*a* to 1*d* after the primary transfer are removed by the cleaning devices 7*a* to 7*d*.

The intermediate transfer belt 8 is stretched around a driven roller 10 on the upstream side and the driving roller 11 on the downstream side. As the driving roller 11 is driven to rotate by a belt driving motor (unillustrated), the intermediate transfer belt 8 starts to rotate counter-clockwise, and the sheet S is conveyed from the registration roller pair 12*b* to the nip (secondary transfer nip) between the driving roller 11 and the secondary transfer roller 9 arranged adjacent to it with predetermined timing. The full-color image on the intermediate transfer belt 8 is thus secondarily transferred to the sheet S. The sheet S on which toner images have been secondarily transferred is conveyed to the fixing device 13.

The sheet S conveyed to the fixing device 13 is heated and pressed by a fixing belt 21 (first fixing member) and a pressing roller 22 (second fixing member) so that the toner images are fixed on the surface of the sheet S (see FIG. 2), and thus the predetermined full-color image is formed on it. The sheet S on which the full-color image has been formed has its conveying direction switched by a branch portion 14 which is branched into a plurality of directions, and is then directly (or after being directed to a duplex printing conveying passage 18 to have images formed on both its faces) discharged to a discharge tray 17 by a discharge roller pair 15.

Figure 2:
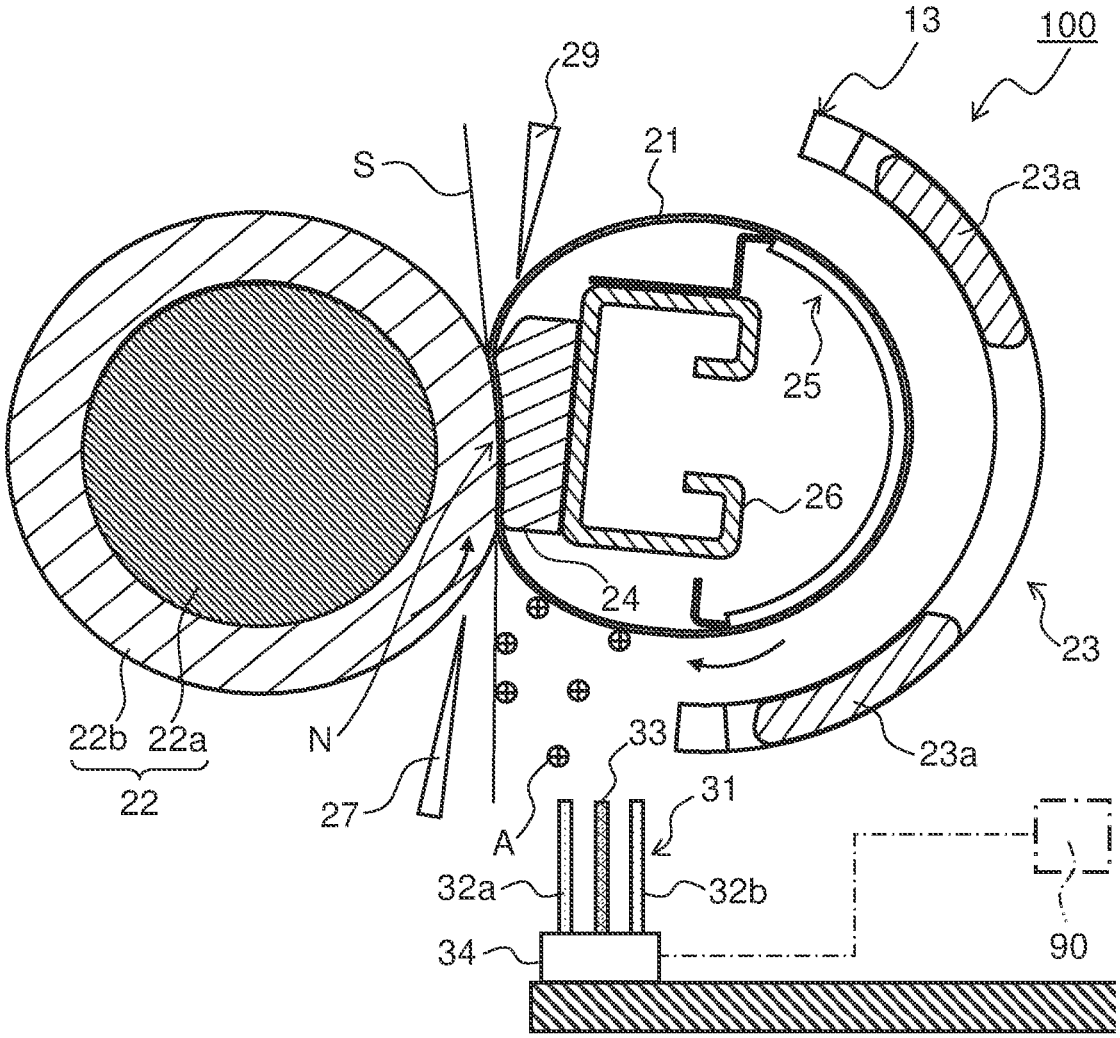
FIG. 2 is a side sectional view of a fixing device incorporated in the image forming apparatus.

FIG. 2 is a side sectional view of the fixing device 13 incorporated in the image forming apparatus 100. The top side of FIG. 2 corresponds to the downstream side of the fixing device 13 in the sheet insertion direction (sheet conveying direction), and the bottom side of FIG. 2 corresponds to the upstream side of the fixing device 13 in the sheet insertion direction. The fixing device 13 includes, as shown in FIG. 2, the fixing belt 21, the pressing roller 22, a heating portion 23, a nip forming member 24, a belt guide 25, a frame member 26, and a charging portion 31. The fixing device 13 also includes a control portion 90. The control portion 90 may be provided at any place inside the image forming apparatus 100 or may be provided in the fixing device 13.

The fixing belt 21 is supported on a housing (not shown) of the fixing device 13 so as to be rotatable about a horizontal rotation axis. The fixing belt 21 is endless and is formed, for example, in a cylindrical shape with an outer diameter of 20 to 50 mm, and has approximately the same length in the axial direction (in the width direction of the sheet S) as the pressing roller 22. The fixing belt 21 rotates clockwise in FIG. 2 along the insertion direction of the sheet S.

The fixing belt 21 has a layered structure in which an elastic layer and a release layer are laid around the outer circumference of a heat generation layer, which is a base layer. The heat generation layer is formed of, for example, a metal film such as of nickel with a thickness of 30 to 50 μm or, for example, a polyimide film with a thickness of 50 to 100 μm mixed with metal powder such as of copper, silver, or aluminum. The elastic layer is formed of, for example, silicone rubber or the like with a thickness of 100 to 500 μm. The release layer is formed of, for example, a fluororesin such as PFA (tetrafluoroethylene-perfluoroalkylvinyl ether copolymer) with a thickness of 30 to 50 μm.

The pressing roller 22 is supported on the housing of the fixing device 13 so as to be rotatable about a horizontal rotation axis. The pressing roller 22 is in a cylindrical shape and has approximately the same length in the axial direction (in the width direction of the sheet S) as the fixing belt 21. To the pressing roller 22, a predetermined pressure toward the fixing belt 21 is applied by a pressing mechanism 30 (see FIG. 3). The outer circumferential face of the pressing roller 22 presses the nip forming member 24 via the fixing belt 21 and is thereby kept in pressed contact with the outer circumferential face of the fixing belt 21 to form a fixing nip N (nip).

The pressing roller 22 is connected to the fixing drive motor 45 (see FIG. 3) and rotates counter-clockwise in FIG. 2. The pressing roller 22 makes contact with the outer circumferential face of the fixing belt 21 to apply a clockwise rotation driving force to the fixing belt 21.

The pressing roller 22 a the layered structure in which an elastic layer 22*b* is laid around the outer circumference of a metal base 22*a* with a release layer (not shown) laid around the surface of the elastic layer 22*b*. The metal base 22*a* is formed of, for example, metal such as aluminum with a diameter of about 20 mm. The elastic layer 22*b* is formed of, for example, silicone rubber or the like with a thickness of about 8 mm. The release layer is formed of, for example, a fluororesin such as PFA with a thickness of about 10 to 50 μm.

The heating portion 23 is a heater of an induction heating (IH) type that makes the heat generation layer of the fixing belt 21 generate heat by induction heating. The heating portion 23 is arranged opposite from the pressing roller 22 across the fixing belt 21 at a predetermined distance so as to face the outer circumferential face of the fixing belt 21. The heating portion 23 extends slightly longer than the fixing belt 21 along the axial direction of the fixing belt 21 (i.e., the width direction of the sheet S, the direction perpendicular to the plane of FIG. 2). The temperature of the fixing belt 21 is sensed by a thermistor 47 (see FIG. 3).

The heating portion 23 heats the fixing belt 21. The heating portion 23 includes an excitation coil 23*a*, an unillustrated holding member, a core, etc. The excitation coil 23*a* and the core are held at a predetermined position by the holding member. The excitation coil 23*a* is formed of litz wire with a plurality of conductive wire strands bundled together and is wound around so as to extend along the axial direction of the fixing belt 21. The excitation coil 23*a* is formed in an arc shape along the outer circumferential face of the fixing belt 21 in the circumferential direction of the fixing belt 21.

The nip forming member 24 is arranged inward of the fixing belt 21 so as to face the pressing roller 22 across the fixing belt 21. The nip forming member 24 makes contact with the inner circumferential face of the fixing belt 21 and forms a fixing nip N between the fixing belt 21 and the pressing roller 22.

The nip forming member 24 is substantially in the shape of a rectangular parallelepiped that extends almost as long as the fixing belt 21 along the axial direction of the fixing belt 21. The nip forming member 24 includes, for example, a base member formed of metal such as aluminum or a heat-resistant resin such as a liquid crystal polymer.

The surface roughness of the outer circumferential face of the fixing belt 21 increases as the cumulative number of sheets passed n (the total number of sheets S passed through the fixing nip N) increases. Thus, the outer circumferential face of the fixing belt 21 becomes more prone to be electrostatically charged as the number of passing sheet n increases.

The belt guide 25 is arranged inward of the fixing belt 21 so as to face the heating portion 23 across the fixing belt 21. The belt guide 25 makes contact with the inner circumferential face of the fixing belt 21 except at the fixing nip N to support the fixing belt 21 from inside. The belt guide 25 is formed of a sheet metal that extends almost as long as the fixing belt 21 along the axial direction of the fixing belt 21. The belt guide 25 is formed of, for example, an elastic magnetic metal such as SUS430 with a thickness of 0.1 to 0.5 mm.

The frame member 26 is supported on the housing of the fixing device 13 to hold the nip forming member 24 and the belt guide 25. The frame member 26 is arranged at a central place inside the fixing belt 21 in the radial direction, between the belt guide 25 and the nip forming member 24. The frame member 26 extends slightly longer than the fixing belt 21 along the axial direction of the fixing belt 21.

On the upstream side of the fixing nip N in the sheet insertion direction (at the bottom side of FIG. 2), a fixing guide 27 is arranged. The fixing guide 27 guides the sheet S having passed through the secondary transfer nip (see FIG. 1) to the fixing nip N.

On the downstream side (in the upper part of FIG. 2) of the fixing nip N in the sheet insertion direction, a separation claw 29 is arranged. The separation claw 29 separates the sheet S having undergone fixing from the surface of the fixing belt 21. The separation claw 29 is arranged with its tip end portion pointing toward the upstream side of the fixing belt 21 in the rotation direction (in the counter direction) at a predetermined angle so that the tip end portion lies close to the outer circumferential face of the fixing belt 21.

The charging portion 31 is arranged on the upstream side of the fixing belt 21 and the pressing roller 22 in the sheet insertion direction. The charging portion 31 applies positive electric charge to the outer circumferential face of the fixing belt 21 and to the side of the sheet S on which a toner image has been formed.

The charging portion 31 includes counter electrodes 32*a* and 32*b*, a discharge electrode 33, and an electrode holding portion 34. The counter electrodes 32*a* and 32*b* are electrodes that face each other across the discharge electrode 33. The electrode holding portion 34 is supported on the housing of the fixing device 13 and holds the counter electrodes 32*a* and 32*b* and the discharge electrode 33.

The counter electrodes 32*a* and 32*b* and the discharge electrode 33 each have one end fixed to the electrode holding portion 34 and the other end facing the outer circumferential face of the fixing belt 21 across a predetermined space. The discharge electrode 33 is a plate-form electrode made of stainless steel with a comparatively small thickness (for example, about 0.1 mm). An end portion of the discharge electrode 33 closer to the fixing belt 21 is formed in a sawtooth shape.

The discharge electrode 33 is connected to a power supply unit 52 (see FIG. 3) provided in the image forming apparatus 100. When an application mode is performed, the control portion 90 applies a high voltage to the discharge electrode 33. Then, corona discharge occurs between a sawtooth-shaped tip end portion formed in the discharge electrode 33 and the counter electrodes 32*a* and 32*b*, so that an application current Ci passes.

When corona discharge occurs, positive ions A appear around the tip end portion of the discharge electrode 33. Part of the positive ions A separate from the tip end portion of the discharge electrode 33 and some of them reach the outer circumferential face of the fixing belt 21. This gives positive charge to the outer circumferential face of the fixing belt 21, so that the fixing belt 21 is positively charged. Although the amount of electric charge on the outer circumferential face of the fixing belt 21 reduces with time, it remains constant so long as corona discharge continues and keeps producing positive charge.

Another part of the positive ions A that are generated by corona discharge pass through the gap between the fixing belt 21 and the counter electrodes 32*a* and 32*b* to reach the side (closer to the fixing belt 21) of the sheet S yet to pass through the fixing nip N on which a toner image has been formed. This gives positive charge to the side of the sheet S yet to pass through the fixing nip N on which the toner image has been formed, so that it is positively charged.

The control portion 90, during a first period until the passage of a predetermined period, performs the application mode (first application mode) and, during a second period after the passage of the first period until the passage of a predetermined period, performs a standby mode in which the application current Ci is stopped. The control portion 90 performs the application mode (a second application mode) once again after the passage of the second period. The control portion 90 controls the voltage applied to the charging portion 31 such that, during the first period, as the elapsed period after the initial start-up of the fixing device 13 increases, the application current Ci decreases. The control portion 90 controls the voltage applied to the charging portion 31 such that the application current Ci in the second application mode is lower than the application current Ci in the first application mode. How the control portion 90 controls the application current Ci will be described in detail later.

Next, control paths in the image forming apparatus 100 and the fixing device 13 will be described. In actual use of the image forming apparatus 100, different parts of it are controlled in different ways. The following description focuses on those control paths which are necessary for implementing the present disclosure. For such features as have already been mentioned, no overlapping description will be repeated.

Figure 3:
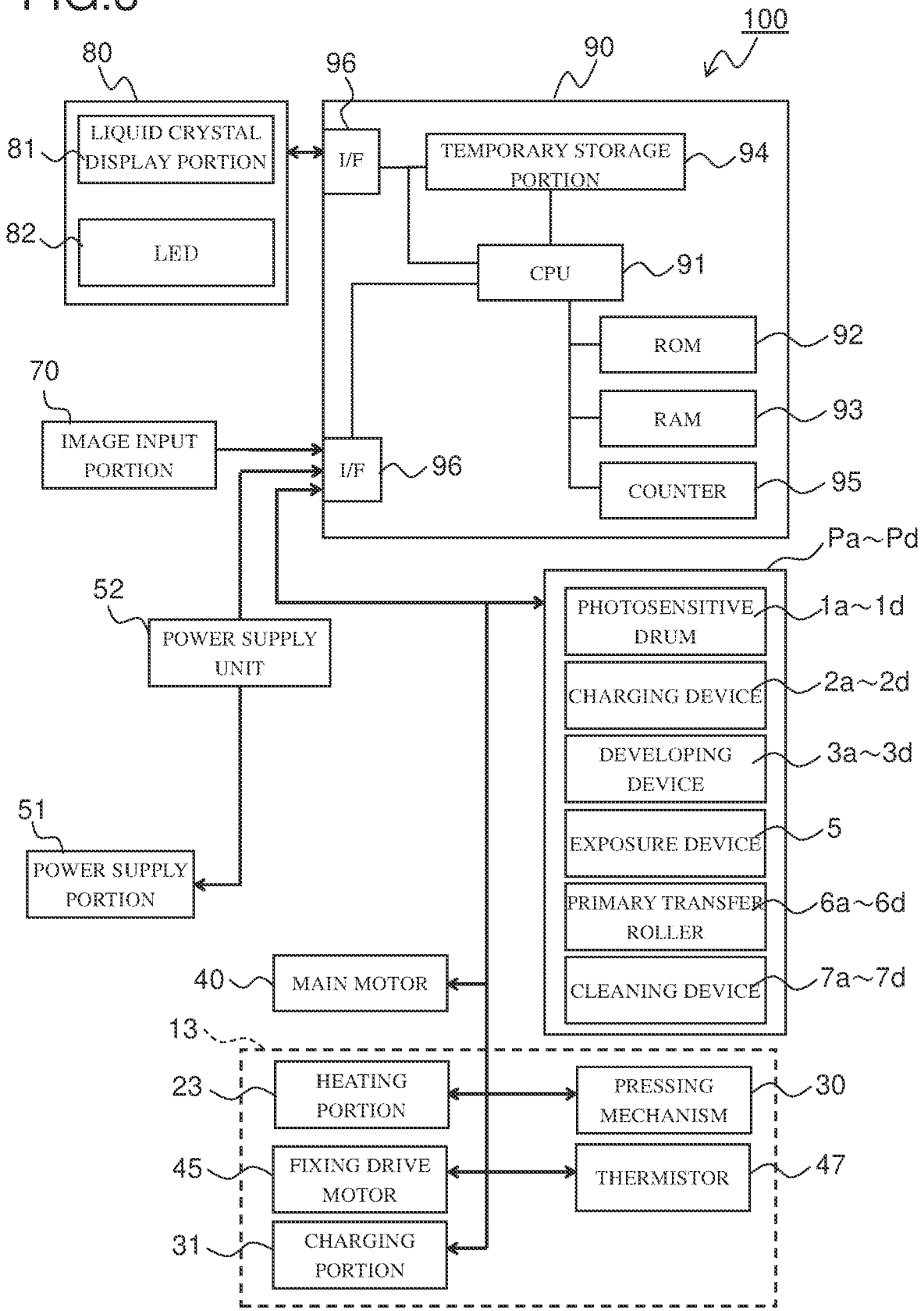
FIG. 3 is a block diagram showing one example of control paths in the image forming apparatus.

FIG. 3 is a block diagram showing one example of control paths in the image forming apparatus 100. As shown in FIG. 3, the control paths in the image forming apparatus 100 include an image input portion 70, an operation portion 80, the control portion 90, image forming portions Pa to Pd, a power supply portion 51, a power supply unit 52, and a fixing device 13.

An image input portion 70 is a reception portion for receiving image data transmitted to the image forming apparatus 100 from a PC or the like. An image signal fed in from the image input portion 70 is converted into a digital signal, which is then fed out to a temporary storage portion 94.

The operation portion 80 has a liquid crystal display portion 81 and LEDs 82 that indicate different statuses, and is configured to display the status of the image forming apparatus 100, the status of image formation, the number of copies printed, and so on. Various settings for the image forming apparatus 100 are made via a printer driver o by specifying on the operation portion 80 the sheet cassette 16 from which to feed the sheet S or a manual feed tray (not shown), it is possible to enter the kind and size of the sheet S n a personal computer.

The control portion 90 at least includes a CPU (central processing unit) 91, a ROM (read-only memory) 92, a RAM (random-access memory) 93, a temporary storage portion 94, a counter 95 (counting portion), and a plurality of (here, two) I/Fs (interfaces) 96. The CPU 91 functions as a central arithmetic processor. The ROM 92 is a read-only storage portion. The RAM 93 is a readable-writable storage portion. The temporary storage portion 94 temporarily stores image data and the like. The I/Fs 96 transmit control signals to different devices in the image forming apparatus 100 and receive input signals from the operation portion 80.

The ROM 92 stores data and the like that are not changed during use of the image forming apparatus 100, such as control programs for the image forming apparatus 100 and values required for control. The RAM 93 stores data generated and needed in the course of controlling the image forming apparatus 100, data temporarily required for control of the image forming apparatus 100, and the like.

For example, the ROM 92 stores the length of the first period after the initial start-up until the passage of a predetermined period. Specifically, the first period is stored as a period in which the cumulative number of sheets passed n after the initial start-up is equal to or smaller than a predetermined first number of sheets n1 (the period in which $n \leq n1$). The ROM 92 also stores the length of the second period after the passage of the first period until the passage of a predetermined period. Specifically, the second period is stored as a period in which the cumulative number of sheets passed n is larger than the first number of sheets n1 but is equal to or smaller than a predetermined second number of sheets n2 (the period in which $n1 < n \leq n2$). The control portion 90 controls the voltage at a predetermined timing during the first period. This timing is stored as a timing at which the cumulative number of sheets passed n becomes equal to or larger than a third number of sheets n3.

The second number of sheets n2 is equal to or larger than 14 times but equal to or smaller than 18 times the first number of sheets. The third number of sheets n3 is equal to or larger than ½ times but equal to or smaller than ⅔ times the first number of sheets. In terms of specific numbers, it is possible to set, for example, the first number of sheets n1 at 500, the second number of sheets n2 at 8000, and the third number of sheets n3 at 500.

In the ROM 92, with respect to the voltage applied to the charging portion 31, different values are stored in accordance with the elapsed period since the initial start-up.

The temporary storage portion 94 temporarily stores an image signal fed from the image input portion 70 and converted into a digital signal. The counter 95 (counting portion) counts the number of sheets S (cumulative number of sheets passed n) inserted through the fixing nip N in a cumulative manner.

The power supply unit 52 is connected to a commercial power source (not shown) via the power supply portion 51. The power supply unit 52 distributes the electric power fed from the power supply portion 51 to different devices (including the charging portion 31) in the image forming apparatus 100 in accordance with an output signal from the control portion 90.

Figure 4:
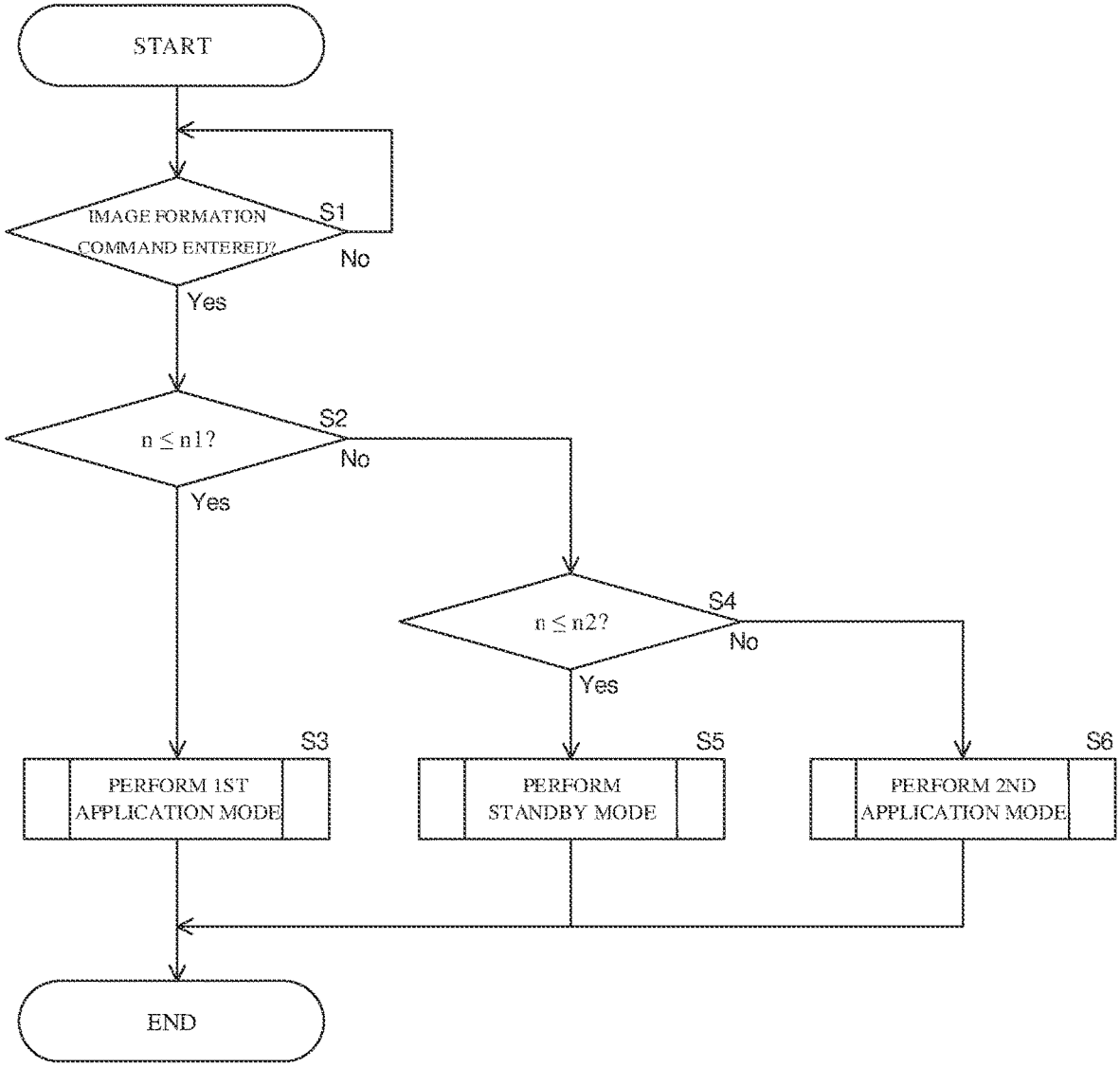
FIG. 4 is a flow chart showing one example of the control procedure for the fixing device.
Figure 5:
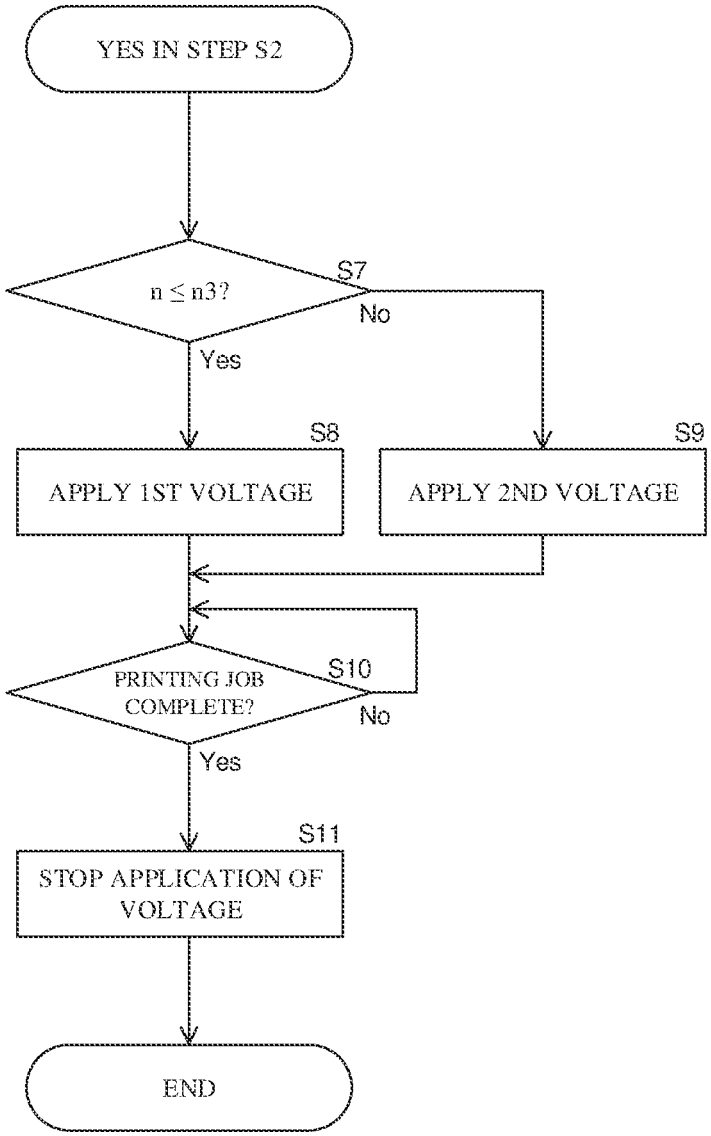
FIG. 5 is a flow chart showing one example of the control procedure for the fixing device when a first application mode is performed.
Figure 6:
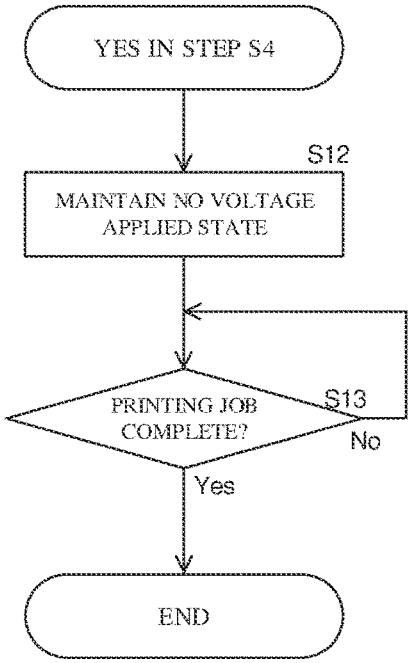
FIG. 6 is a flow chart showing one example of the control procedure for the fixing device when a standby mode is performed.
Figure 7:
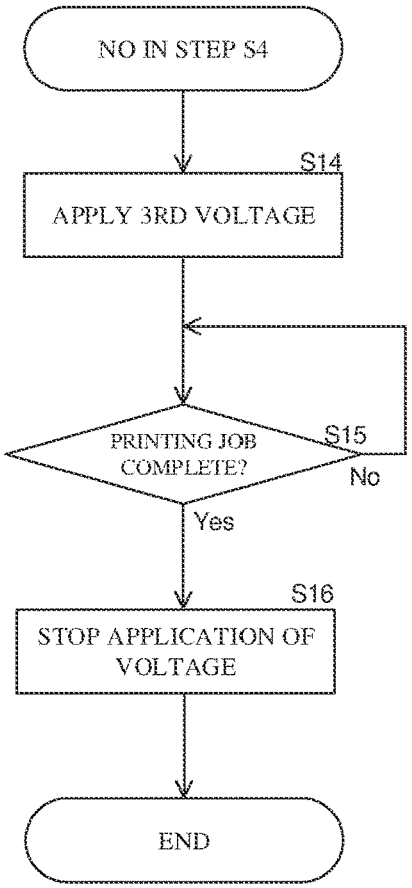
FIG. 7 is a flow chart showing one example of the control procedure for the fixing device when a second application mode is performed.

Next, an example of control of the application current Ci passing through the charging portion 31 in the fixing device 13 according to this embodiment will be described with reference to the flow charts shown in FIGS. 4 to 7. FIG. 4 is a flow chart showing one example of the control procedure for the fixing device 13. FIG. 5 is a flow chart showing one example of the control procedure for the fixing device 13 when the first application mode is performed. FIG. 6 is a flow chart showing one example of the control procedure for the fixing device 13 when the standby mode is performed. FIG. 7 is a flow chart showing one example of the control procedure for the fixing device 13 when the second application mode is performed.

As shown in FIG. 4, the control portion 90 checks whether an image formation command has been entered from a host device such as a personal computer (step S1). So long as no image formation command is entered (No in step S1), a standby state is maintained until an image formation command is entered. When the image formation command is entered (Yes in step S1), whether the first period described above is underway (n≤n1) is determined (step S2). When the first period is underway (n<n1) (Yes in step S2), the control portion 90 performs the first application mode (step S3). The control when the first application mode is performed will be described in detail later.

When the first period is not underway (n>n1) (No in step S2), next, whether the second period is underway (n≤n2) is determined (step S4). When the second period is underway (Yes in step S4), the standby mode is performed (step S5). When the first or second period is not underway (n>n2) (No in step S4), the second application mode is performed (step S6). The control when the waiting mode and the second application mode are performed will be described in detail later.

Next, an example of the control in the first application mode will be described with reference to FIG. 5. In the first application mode (Yes in step S2), first, whether the cumulative number of sheets passed n is equal to or smaller than the third number of sheets n3 (n≤n3) is checked (step S7). When the cumulative number of sheets passed n is equal to or smaller than the third number of sheets n3 (Yes in Step S7), a control signal is transmitted to the power supply unit 52 to set the application current Ci for corona discharge in the charging portion 31 to 7 μA, so that a first voltage is applied to the charging portion 31 (step S8).

When the cumulative number of sheets passed n is equal to or larger than the third number of sheets n3 (No in Step S7), a control signal is transmitted to the power supply unit 52 to set the application current Ci for corona discharge in the charging portion 31 to 5 μA, so that a second voltage is applied to the charging portion 31 (step S8).

Then, whether the printing job is complete is checked (step S10). When the printing job is not complete (No in step S10), the application current Ci continues to be generated. When it is judged that the printing job is complete (Yes in step S10), a control signal is transmitted to the power supply unit 52 to set the application current Ci to 0 μA (Ci=0 μA), so that the application of the voltage to the charging portion 31 is stopped (step S11) and the control of the application current Ci is ended. Here, when one printing job involves printing on a plurality of number of sheets, even if the cumulative number of printed sheets n exceeds the third number of sheets n3 when printing on one sheet is finished, so long as the printing job continues, the application current Ci is not changed.

Next, an example of the control when the standby mode is performed will be described with reference to FIG. 6. When the standby mode is performed (Yes in step S4), a control signal is transmitted to the power supply unit 52 to set the application current Ci to 0 μA (Ci=0 μA), so that a state where no voltage is applied to the charging portion 31 is maintained (step S12), and the state is maintained until the printing job ends (No in step S13). When the printing job is complete (Yes in step S13), the control of the application current Ci is ended.

Next, an example of the control when the second application mode is performed will be described with reference to FIG. 7. When the second application mode is performed (No in step S4), a control signal is transmitted to the power supply unit 52 to set the application current Ci to 2 μA (Ci=2 μA), so that a third voltage is applied to the charging portion 31.

Then, whether the printing job is complete is checked (step S15). When the printing job is not complete (No in step S15), the voltage mentioned above continues to be applied so that the application current Ci continues to be generated. When it is judged that the printing job is complete (Yes in step S15), a control signal is transmitted to the power supply unit 52 to set the application current Ci to 0 (Ci=0 μA), so that the application of the voltage to the charging portion 31 is stopped (step S16), and the control of the application current Ci is ended.

As described above, the outer circumferential face of the fixing belt 21 becomes more prone to be electrostatically charged as the cumulative number of sheets passed n increases. In other words, during the first period after the initial start-up until the passage of a predetermined period, the fixing belt 21 is comparatively less prone to be electrostatically charged, and unless some measures are taken, an electrostatic offset tends to occur. Thus, the control portion 90 for the fixing device 13 according to the first embodiment performs the application mode during the first period to give positive charge to the outer circumferential face of the fixing belt 21 and to the surface of the sheet S. Then, during the first period, the sheet S and the outer circumferential face of the fixing belt 21 become charged with electric charge of the same (positive) polarity. Thus, part of the toner in an unfixed toner image on the sheet S is less likely to attach to the fixing belt 21, and this helps suppress occurrence of an electrostatic offset.

The outer circumferential face of the fixing belt 21 during the second period is more prone to be electrostatically charged than during the first period. If a comparatively high voltage is applied to the charging portion 31 during the second period, the amount of positive electric charge on the outer circumferential face of the fixing belt 21 increases. Then, electrostatic scattering of toner may occur on the surface of the sheet S to which electric charges of the same (positive) polarity are applied. Thus, the control portion 90 for the fixing device 13 according to the first embodiment performs the standby mode during the second period. Thus, during the second period, the amount of positive electric charge on the outer circumferential face of the fixing belt 21 does not increase. This helps suppress electrostatic scattering of toner.

As described above, the outer circumferential face of the fixing belt 21 during the second period is prone to be electrostatically charged. Thus, the positive electric charge with which the outer circumferential face of the fixing belt 21 is charged during the first period is prone to stay on there. Thus, even if the standby mode is performed during the second period, the toner on the sheet S is less likely to attach to the outer circumferential face of the fixing belt 21. Thus, also during the second period, an electrostatic offset can be suppressed.

Since no application current Ci passes during the second period, deterioration of the counter electrodes 32*a*, 32*b*, the discharge electrode 33, and the outer circumferential face of the fixing belt 21 can be suppressed. Thus, it is possible to provide a fixing device 13 that can suppress occurrence of image defects and that is less prone to deterioration.

As described above, also during the application mode, as the elapsed period after the initial start-up becomes longer, the voltage applied to the charging portion 31 is reduced. Specifically, the voltage applied to the charging portion 31 is reduced such that, at a timing at which the cumulative number of sheets passed n exceeds the third number of sheets n3 during the first period, the current that appears in the charging portion 31 falls from 7 μA to 5 μA. In this way, it is possible to suppress deterioration of the counter electrodes 32*a* and 32*b*, the discharge electrode 33, and the outer circumferential face of the fixing belt 21.

Also as described above, the standby mode is performed during the second period, and thus the amount of electric charge on the outer circumferential face of the fixing belt 21 decreases with time. However, the second application mode is performed after the passage of the second period; thus, it is possible to suppress occurrence of an electrostatic offset even after the second period has passed. The outer circumferential face of the fixing belt 21 after the second period has passed is more prone to be electrostatically charged than during the first and second periods. Thus, also by making the application current Ci in the second application mode lower than the application current Ci in the first application mode, it is possible to suppress occurrence of an electrostatic offset. Thus, it is possible to suppress image defects while suppressing deterioration of the charging portion 31 and the fixing belt 21.

As described above, the counter electrodes 32*a* and 32*b* are arranged so as to face each other across the discharge electrode 33. This leads to stable corona discharge.

Next, a second embodiment of the present disclosure will be described. The control portion 90 for the fixing device 13 according to this embodiment controls the magnitude of the voltage applied to the charging portion 31 such that, as the surface roughness of the outer circumferential face of the fixing belt 21 increases from that in the state of the fixing device 13 during the initial start-up, the application current Ci decreases.

Specifically, the control portion 90 reduces the application current Ci as periods change from the first period described above, in which the surface roughness of the outer circumferential face of the fixing belt 21 increases from a state during the initial start-up to a predetermined state, to the second period described above, in which the surface roughness further increases from the state after the passage of the first period to a predetermined state, and then to a third period in which the surface roughness further increases from the state after the passage of the second period. The third period is a period in which the cumulative number of sheets passed n is larger than in the second period (n2≤n).

It is preferable that the second application current Ci that passes during the second period be equal to or larger than 4/7 times but smaller than 6/7 times the first application current Ci that passes during the first period. On the other hand, it is preferable that the third application current Ci that passes during the third period be equal to or larger than 1/7 times but smaller than 4/7 times the first application current Ci. The control portion 90 controls the application current Ci by changing the voltage applied to the charging portion 31 among the first, second, and third voltages. How the control portion 90 controls the application current Ci will be described in detail later.

Figure 8:
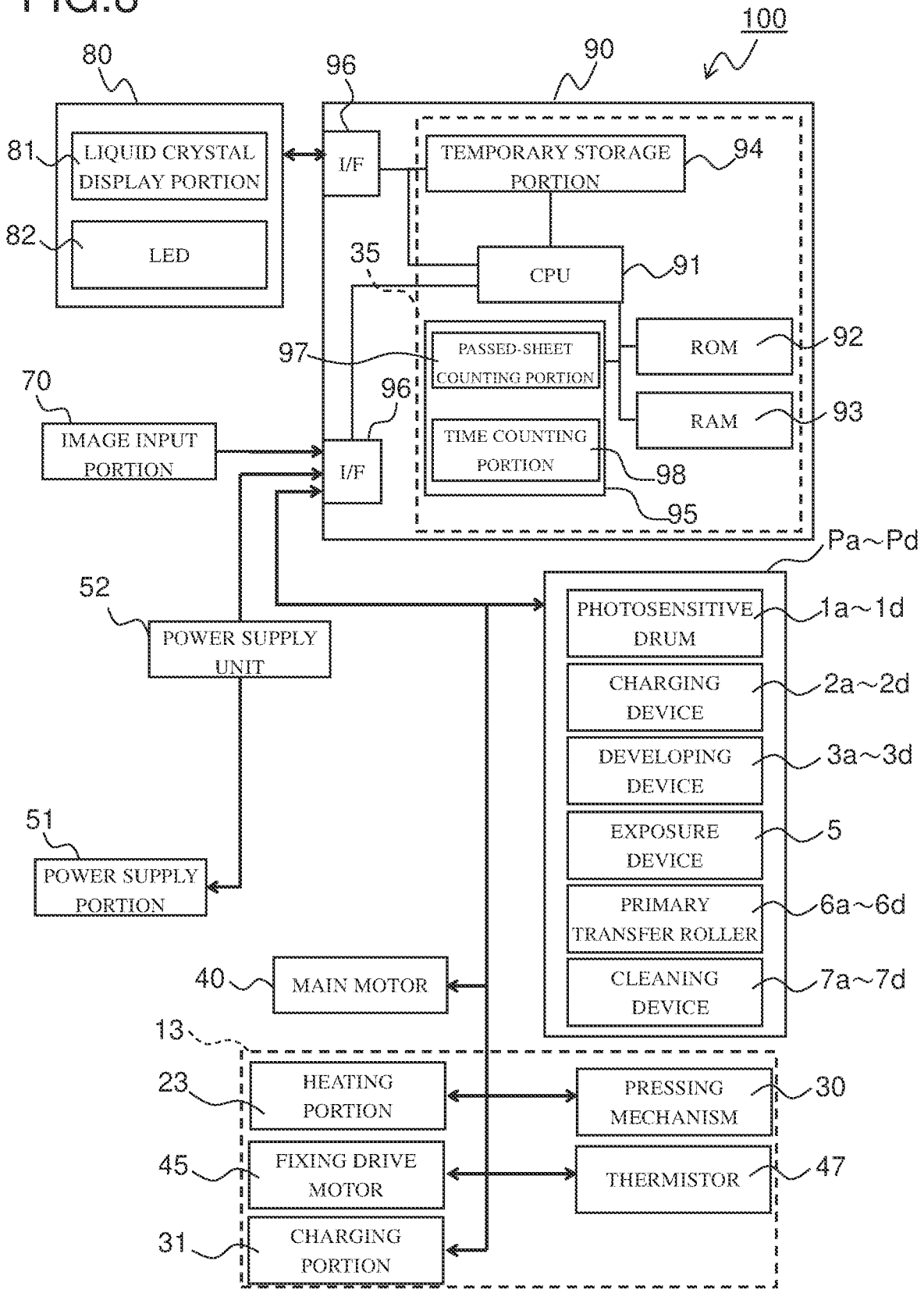
FIG. 8 is a block diagram showing another example of the control paths in the image forming apparatus.

FIG. 8 is a block diagram of the control portion 90 for the fixing device 13 according to the second embodiment. As shown in FIG. 8, the control portion 90 includes a surface roughness calculation portion 35 (a surface roughness sensing portion).

The counter 95 includes a passed-sheet counting portion 97 that counts the number of sheets S (cumulative number of sheets passed n) passed through the fixing nip N in a cumulative manner and a time counting portion 98 that counts the elapsed period after the initial start-up. The elapsed period can be the cumulative time for which a rotation driving force has been applied to the fixing belt 21. The numbers counted by the passed-sheet counting portion 97 and the time counting portion 98 are stored in the temporary storage portion 94.

The surface roughness calculation portion 35 includes the counter 95, the ROM 92, the RAM 93, and the temporary storage portion 94 and, based on the values stored in them, calculates the surface roughness of the outer circumferential face of the fixing belt 21. Specifically, the surface roughness calculation portion 35 determines which of the first, second, and third periods the elapsed period after the initial start-up is based on the cumulative number of sheets passed n counted by the passed-sheet counting portion 97 and stored in the temporary storage portion 94 as well as the first and second number of sheets n1 and n2 stored in the ROM. As described above, the surface roughness of the outer circumferential face of the fixing belt 21 increases gradually as periods change from the first period to the second period and then to the third period; thus, the control portion 90 controls the application current Ci in accordance with the period determined by the surface roughness calculation portion 35.

Figure 9:
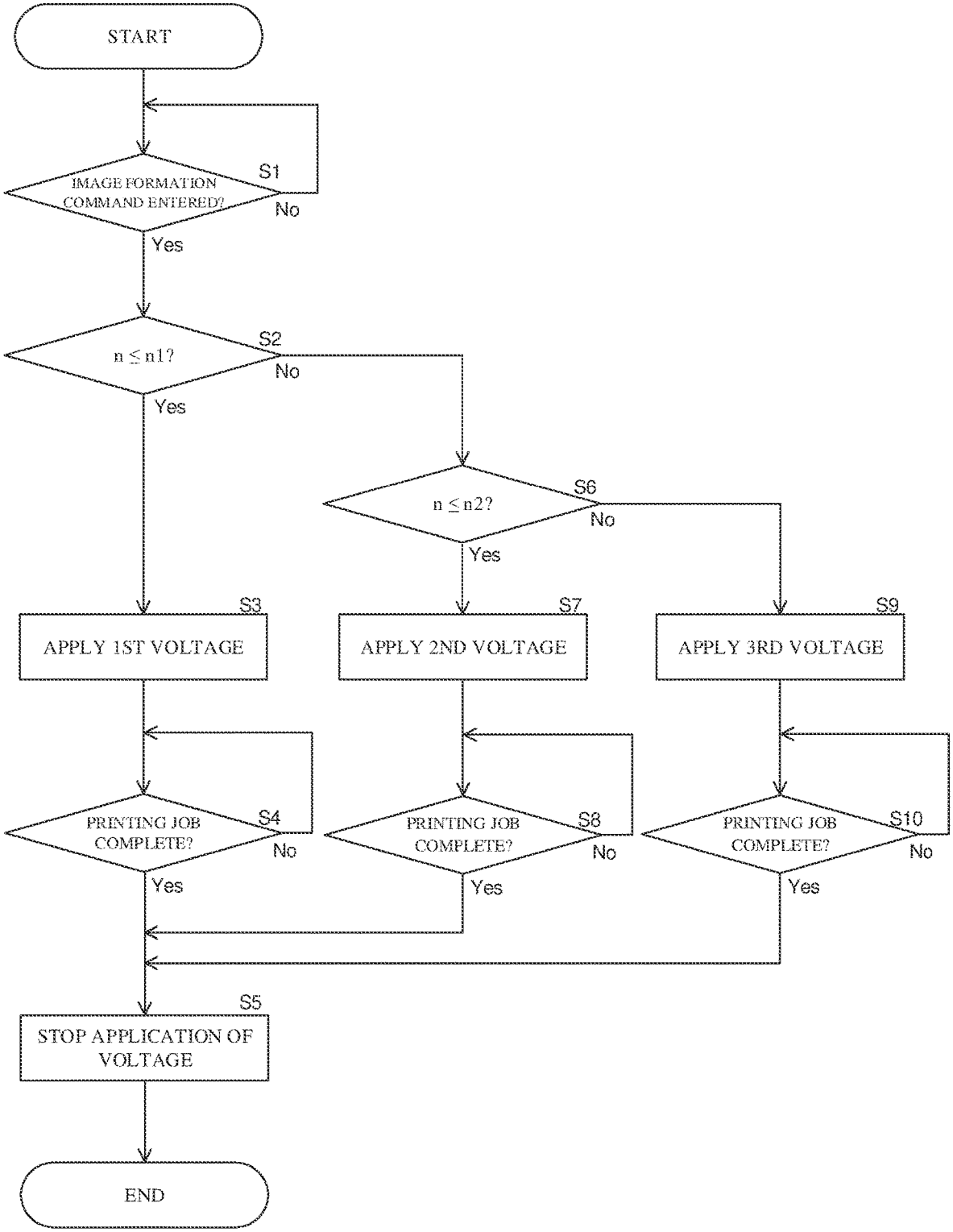
FIG. 9 is a flow chart showing another example of the control procedure for the fixing device.

Next, an example of control of the application current Ci passing through the charging portion 31 in the fixing device 13 according to this embodiment will be described with reference to the flow chart in FIG. 9. FIG. 9 is a flow chart showing one example of the control procedure for the fixing device 13 according to this embodiment.

As shown in FIG. 9, the control portion 90 checks whether an image formation command has been entered from a host device such as a personal computer (step S1). So long as no image formation command is entered (No in step S1), the standby state is maintained until an image formation command is entered.

When the image formation command is entered (Yes in step S1), whether the first period described above is underway (n≤n1) is checked (step S2). When the first period is underway (n≤n1) (Yes in Step S2), the control portion 90 transmits a control signal to the power supply unit 52 to set the application current Ci for corona discharge in the charging portion 31 to 7 μA, so that the first voltage is applied to the charging portion 31 (step S3).

Next, whether the printing job is complete is checked (step S4). When the printing job is not complete (No in step S4), the application current Ci continues to be generated. Here, when one printing job involves printing on a plurality of number of sheets, even if the cumulative number of printed sheets n exceeds the first number of sheets n1 when printing on one sheet is finished, so long as the printing job continues, the application current Ci is not changed. When it is judged that the printing job is complete (Yes in step S4), a control signal is transmitted to the power supply unit 52 to set the application current Ci to 0 μA (Ci=0 μA), so that the application of the voltage to the charging portion 31 is stopped (step S5) and the control of the application current Ci is ended.

When, in step 2, it is judged that the first period is not underway (n>n1) (No in step S2), next, whether the second period is underway (n≤n2) is checked (step S6). When the second period is underway (Yes in Step S6), a control signal is transmitted to the power supply unit 52 to set the application current Ci for corona discharge in the charging portion 31 to 5 μA, so that the second voltage is applied to the charging portion 31 (step S7).

Next, whether the printing job is complete is checked (step S8). When the printing job is not complete (No in step S8), the application current Ci continues to be generated. Here, when one printing job involves printing on a plurality of number of sheets, even if the cumulative number of printed sheets n exceeds the second number of sheets n2 when printing on one sheet is finished, so long as the printing job continues, the application current Ci is not changed. When it is judged that the printing job is complete (Yes in step S8), a control signal is transmitted to the power supply unit 52 to set the application current Ci to 0 μA (Ci=0 μA), so that the application of the voltage to the charging portion 31 is stopped (step S5) and the control of the application current Ci is ended.

When, in step 6, it is judged that the second period is not underway (n>n2) (No in Step S6), a control signal is transmitted to the power supply unit 52 to set the application current Ci for corona discharge in the charging portion 31 to 2 μA, so that the third voltage is applied to the charging portion 31 (step S9).

Next, whether the printing job is complete is checked (step S10). When the printing job is not complete (No in step S10), the application current Ci continues to be generated. Here, when one printing job involves printing on a plurality of number of sheets, even if the cumulative number of printed sheets n exceeds the third number of sheets n3 when printing on one sheet is finished, so long as the printing job continues, the application current Ci is not changed. When it is judged that the printing job is complete (Yes in step S10), a control signal is transmitted to the power supply unit 52 to set the application current Ci to 0 μA (Ci=0 μA), so that the application of the voltage to the charging portion 31 is stopped (step S5) and the control of the application current Ci is ended.

With the fixing device 13 according to this embodiment, as in the first embodiment, during the first period, the sheet S and the outer circumferential face of the fixing belt 21 have electric charges of the same (positive) polarity, and, during the second period, an increase in positive electric charge on the outer circumferential face of the fixing belt 21 is suppressed; thus it is possible to suppress occurrence of electrostatic scattering of toner while suppressing an electrostatic offset.

The outer circumferential face of the fixing belt 21 during the third period is more prone to be electrostatically charged than during the second period. Thus, by applying the third voltage, which is lower than the second voltage, to the charging portion 31 during the third period, it is possible to suppress occurrence of electrostatic scattering of toner while suppressing an electrostatic offset.

As the surface roughness of the outer circumferential face of the fixing belt 21 increases, that is, as the elapsed time since the initial start-up increases, the application current Ci decreases; thus, it is possible to prevent deterioration of the counter electrodes 32*a* and 32*b*, the discharge electrode 33, and the outer circumferential face of the fixing belt 21. Thus, it is possible to provide a fixing device 13 that can suppress occurrence of image defects and that is less prone to deterioration.

Next, a third embodiment of the present disclosure will be described. The control portion 90 for the fixing device 13 according to this embodiment controls the voltage applied to the charging portion 31 so as to reduce the application current Ci passing through the charging portion 31 in accordance with the dimension (total length) L of the sheet S in the insertion direction.

Specifically, as the dimension L of the sheet S in the insertion direction which is inserted through the fixing nip N decreases, the application current is reduced. For example, when the dimension L of the sheet S in the insertion direction is larger than a predetermined reference length L1, a first voltage is applied to the charging portion 31. The application current Ci at this time is referred to as a first current. When the dimension L of the sheet S in the insertion direction is equal to or smaller than the reference length L1, a second voltage is applied to the charging portion 31. The application current Ci at this time is referred to as a second current.

It is preferable that the reference length L1 be slightly larger than the dimension of the A4 size in the shorter-side direction; for example, it can be equal to or larger than 215 mm but equal to or smaller than 225 mm. The second current is lower than the first current by at least 0.9 μA but not more than 1.1 μA. How the control portion 90 controls the application current Ci will be described in detail later.

Next, control paths in the fixing device 13 according to this embodiment will be described with reference to FIG. 10. For features similar to those in the embodiments described above, no overlapping description will be repeated.

Figure 10:
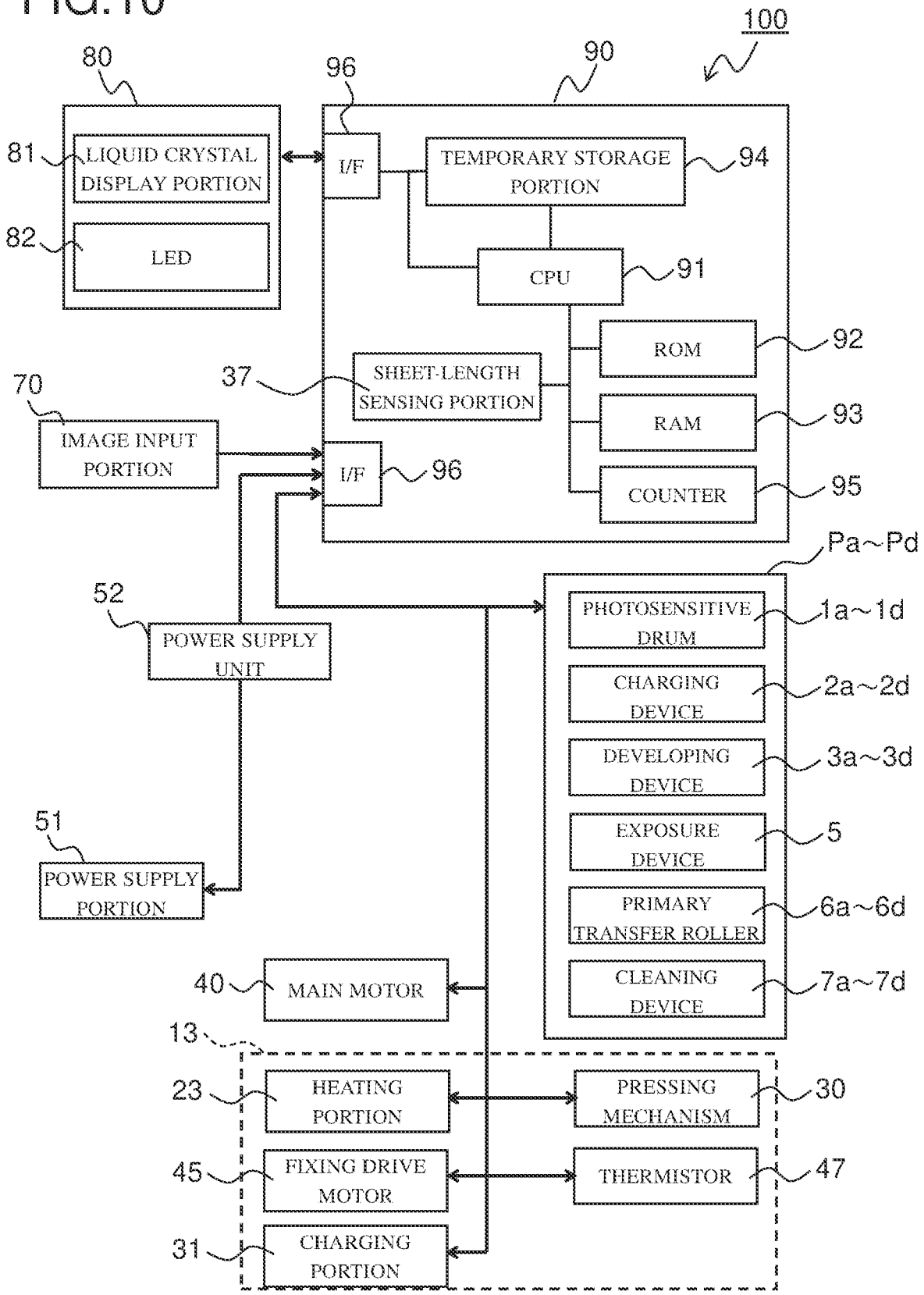
FIG. 10 is a block diagram showing another example of the control paths in the image forming apparatus.

FIG. 10 is a block diagram showing one example of control paths in the fixing device 13 according to this embodiment. As shown in FIG. 10, the control portion 90 includes a sheet-length sensing portion 37. In the ROM 92, the value of the reference length L1 is recorded. Based on image data fed from the image input portion 70, the sheet-length sensing portion 37 senses the dimension L, in the conveying direction, of the sheet S to be printed in a printing job.

Figure 11:
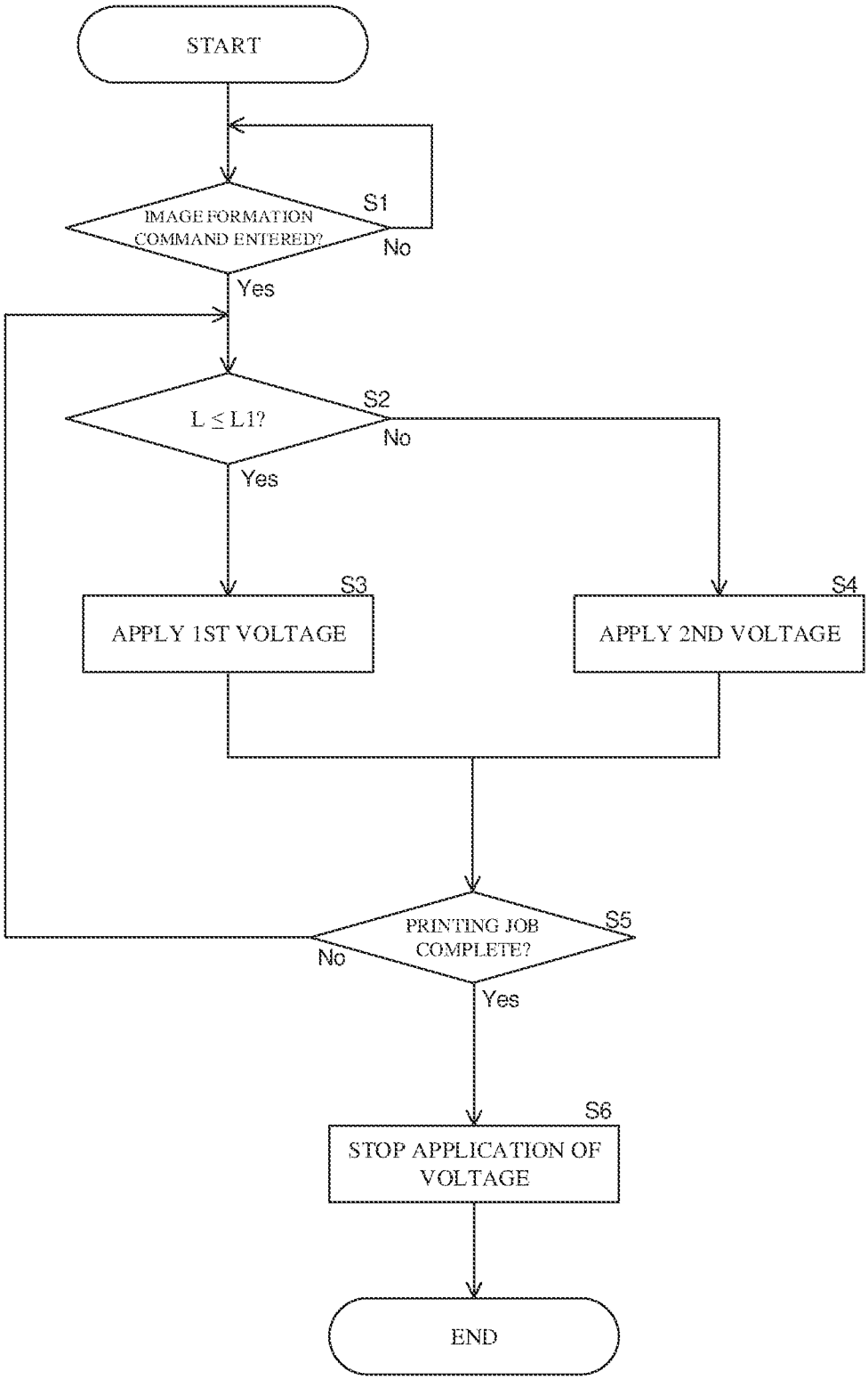
FIG. 11 is a flow chart showing another example of the control procedure for the fixing device.

Next, an example of control of the application current Ci passing through the charging portion 31 in the fixing device 13 according to this embodiment will be described with reference to the flow chart in FIG. 11. FIG. 11 is a flow chart showing one example of the control procedure for the fixing device 13 according to this embodiment.

As shown in FIG. 11, the control portion 90 checks whether an image formation command has been entered from a host device such as a personal computer (step S1). So long as no image formation command is entered (No in step S1), the standby state is maintained until an image formation command is entered.

When the image formation command is entered (Yes in step S1), it is checked whether the dimension L of the sheet S in the conveying direction on which an image is to be formed is equal to or smaller than the reference length L1 (step S2). When the dimension L is equal to or smaller than the reference length L1 (Yes in step S2), the control portion 90 transmits a control signal to the power supply unit 52, so that the first voltage is applied to the charging portion 31 to generate the first current until one sheet S is discharged from the fixing nip N (step S3).

When, in step S2, it is judged that the dimension L of the sheet S in the conveying direction is larger than the reference length L1 (No in step S2), the control portion 90 transmits a control signal to the power supply unit 52, so that the second voltage is applied to the charging portion 31 to generate the second current until one sheet S is discharged from the fixing nip N (step S4).

Next, whether the printing job is complete is checked (step S5). When the printing job is not complete (No in step S5), the procedure returns to step S2 to check whether the dimension L, in the conveying direction, of the subsequent sheet S to be inserted through the fixing nip N is equal to or smaller than the reference length L1, and thereafter, a similar procedure is repeated (step S2 to S4). When, in step S5, it is judged that the printing job is complete (Yes in step S5), a control signal is transmitted to the power supply unit 52 to set the application current Ci to 0 μA, so that the application of the voltage to the charging portion 31 is stopped (step S6) and the control of the application current Ci is ended.

As described above, the control portion 90 controls the voltage applied to the charging portion 31 so as to reduce the application current Ci as the dimension of the sheet S in the insertion direction decreases. When the dimension of the sheet S in the conveying direction is comparatively small, the potential on the outer circumferential face of the fixing belt 21 exhibits a small drop. Thus, it is possible to suppress an electrostatic offset while suppressing deterioration of the fixing belt 21 and the charging portion 31. The magnitude of the application current Ci is controlled in accordance with the dimension of the sheet S in the conveying direction; thus, it is possible to suppress an electrostatic offset without passing a comparatively high application current Ci that may cause electrostatic scattering of toner. Thus, it is possible to provide a fixing device 13 that excels in durability while suppressing an electrostatic offset and electrostatic scattering of toner, and to provide an image forming apparatus 100 incorporating such a fixing device 13.

Generally, when the dimension of the sheet S in the conveying direction exceeds 210 mm, which is the dimension of the A4 size in that direction, an electrostatic offset is more likely to occur around the trailing edge of the sheet S. As described above, by setting the reference length L1 to equal to or larger than 215 mm but equal to or smaller than 225 mm and by controlling the application current Ci based on the reference length L1, it is possible to provide a fixing device 13 that excels in durability while suppressing an electrostatic offset more effectively.

The embodiments described above are in no way meant to limit the present disclosure, which thus allows for many modifications and variations within the spirit of the present disclosure. For example, in the first and second embodiments described above, the first and second periods are defined based on the cumulative number of sheets passed n; instead, the elapsed period after the initial start-up may be calculated based on any value other than the cumulative number of sheets passed n.

For one example, it is possible to make the counting portion count and store the cumulative time (cumulative driven time) for which a rotation driving force has been applied to the pressing roller 22. In this case, stored in the ROM 92 are the cumulative driven times in the first and second periods respectively. The control portion 90 calculates the elapsed period after the initial start-up based on the cumulative driven time stored in the counting portion and the values of the cumulative driven times in those periods stored in the ROM 92.

As another example of the one example described above, it is possible to have a maintenance worker measure the surface roughness of the fixing belt 21 periodically and enter the measured value so that the control portion 90 can determine which of the first, second, and third periods is underway based on the measured value. Or, the control portion 90 may, without determining which of the first, second, and third periods is underway, determine the voltage applied to the charging portion 31 directly based on the measured value. In this case, stored in the ROM 92 is the magnitude of the application voltage applied to the charging portion 31 in accordance with the measured value of the surface roughness entered.

Figure 12:
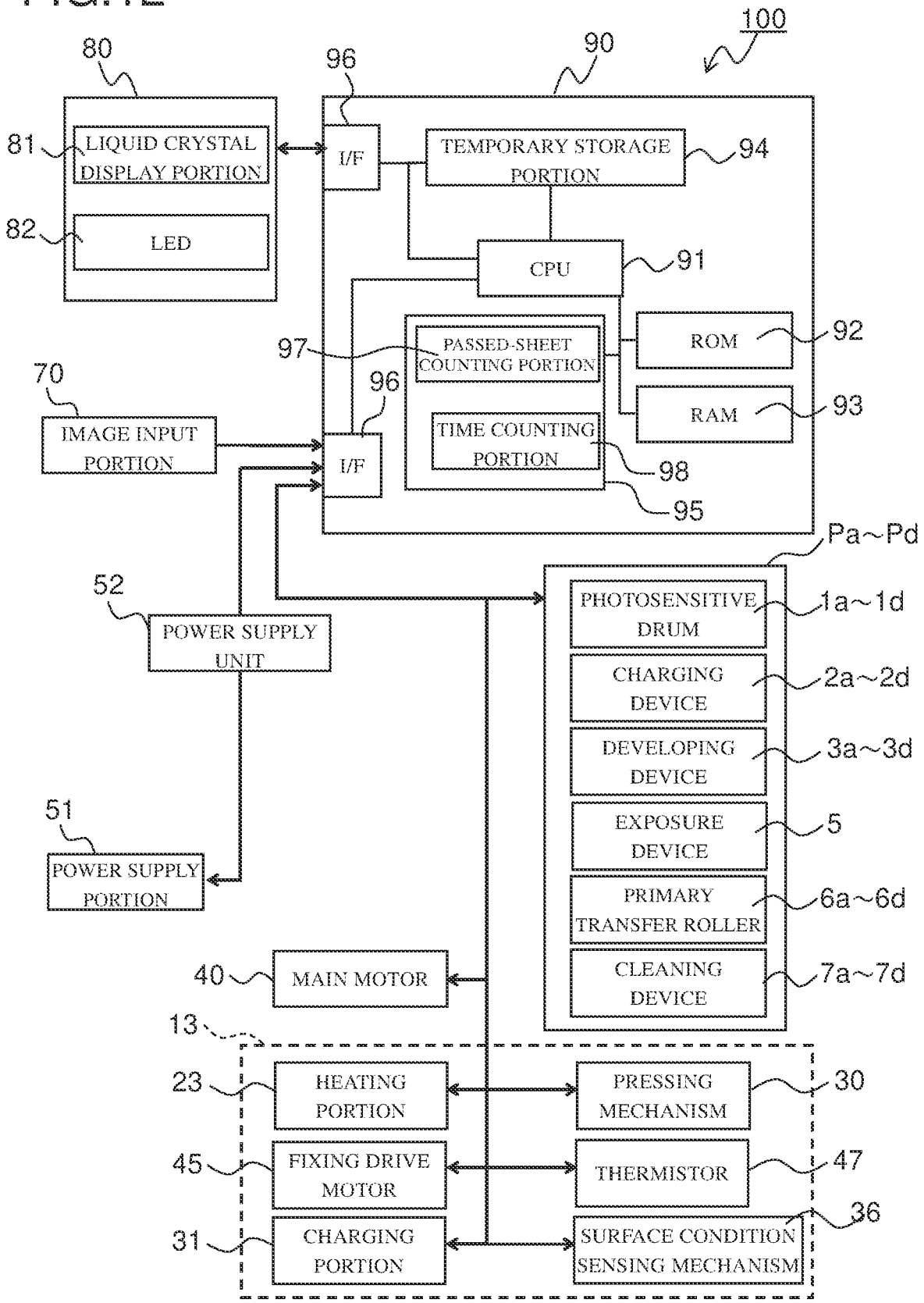
FIG. 12 is a block diagram showing a modified example of the control portion in the fixing device according to the present disclosure.

As yet another example of the one example described above, as shown in FIG. 12, a configuration is also possible where the fixing device 13 includes a surface condition sensing mechanism 36. The surface condition sensing mechanism 36 is a mechanism including a sensor or the like that can sense the surface roughness of the outer circumferential face of the fixing belt 21. In this case, the control portion 90 judges the elapsed period after the initial start-up (the first, second, or third period) based on the surface roughness sensed by the surface condition sensing mechanism 36 and determines the voltage applied to the charging portion 31.

The control portion 90 for the fixing device 13 according to the third embodiment described above, by judging whether the dimension L of the sheet S in the conveying direction is equal to or smaller than the reference length L1, controls the application current Ci to set it to either the first or second current. Instead, it is also possible to set a plurality of reference lengths. For example, it is possible to set a plurality of reference lengths other than the reference length L1 in the above embodiment described above and, in accordance with the dimension L of the sheet S in the conveying direction, control the application current Ci in multiple steps including the first and second currents. In this way, it is possible to reduce the application current Ci while suppressing image defects (electrostatic offset, electrostatic scattering of toner) more effectively, and to suppress deterioration of the charging portion 31 and the fixing belt 21 more effectively.

Although, in the sheet-length sensing portion 37 in the fixing device 13 according to the third embodiment described above, the dimension of the sheet S in the conveying direction is sensed based on the image fed in from the image input portion 70, this is not meant as any limitation. For example, the fixing device 13 may be configured to include a detection sensor such as a photo sensor that can sense the dimension of the sheet S in the conveying direction inserted through the fixing nip N. In this case, the sheet-length sensing portion 37 can sense the dimension of the sheet S in the conveying direction based on the sensing result of the detection sensor. Or, the sheet-length sensing portion 37 may be omitted, in which case the control portion 90 may be configured to sense the dimension of the sheet S in the conveying direction based on the size of the sheet S entered by a user on the operation portion 80.

Although the embodiments described above deal with, as an example, a fixing device 13 employing a sliding belt system in which an endless fixing belt 21 as a heated rotary member slides on the nip forming member 24, it is also possible to apply similar configurations to, for example, a fixing device employing a uniaxial belt system in which the fixing belt 21 is wound around the fixing roller or employing a biaxial belt system in which the fixing belt 21 is stretched around the fixing roller and the heating roller, or to a fixing device including a heated rotary member other than the fixing belt 21.

The present disclosure is applicable to an image forming apparatus provided with a fixing device which inserts a recording medium through a fixing nip formed by a heated rotary member and a pressing member to add heat and pressure to a toner image, so that the toner image is fused and fixed to the recording medium. Based on the present disclosure, it is possible to provide an image forming apparatus that has a comparatively longer product life while suppressing occurrence of image defects.

What is claimed is:

1. A fixing device comprising:

a first fixing member that makes contact with a toner image on a sheet conveyed along a conveying passage;

a second fixing member that forms, between itself and the first fixing member, a nip through which the sheet passes;

a charging portion that generates an application current for applying electric charge so as to apply the electric charge to a part of an outer circumferential face of the first fixing member on an upstream side of the nip in a moving direction of the outer circumferential face and to the toner image on the sheet; and a control portion that controls the charging portion;

wherein the control portion can perform an application mode in which the application current is generated and a standby mode in which no application current is generated, the control portion performing the application mode during a first period after initial start-up until passage of a predetermined period, and performing the standby mode during a second period after passage of the first period until passage of a predetermined period, and when the cumulative numbers of sheets passed after passage of the first and second periods are referred to as a first number of sheets and a second number of sheets respectively, the second number of sheets is equal to or larger than 14 times but equal to or smaller than 18 times the first number of sheets.

2. The fixing device according to claim 1, wherein the control portion reduces the application current as an elapsed period after the initial start-up increases.

3. The fixing device according to claim 1, wherein the control portion performs the application mode again after passage of the second period.

4. The fixing device according to claim 1, further comprising a passed-sheet counting portion that counts a cumulative number of sheets passed which is a number of sheets passed through the nip since the initial start-up, wherein the control portion calculates an elapsed period since the initial start-up based on the cumulative number of sheets passed.

5. The fixing device according to claim 1, wherein the charging portion includes a discharge electrode and a counter electrode that are arranged away from the outer circumferential face of the first fixing member, the charge portion producing corona discharge between the discharge electrode and the counter electrode to generate the application current.

6. An image forming apparatus comprising:

an image forming portion that is arranged upstream of the nip in a conveying direction of the sheet and that forms a toner image on a sheet; and the fixing device according to claim 1 that fixes the toner image on the sheet to the sheet.

7. A fixing device comprising:

a first fixing member that makes contact with a toner image on a sheet conveyed along a conveying passage;

a second fixing member that forms, between itself and the first fixing member, a nip through which the sheet passes;

a charging portion that generates an application current for applying electric charge so as to apply the electric charge to a part of an outer circumferential face of the first fixing member on an upstream side of the nip in a moving direction of the outer circumferential face and to the toner image on the sheet; and a control portion that controls the charging portion wherein the control portion can perform an application mode in which the application current is generated and a standby mode in which no application current is generated, the control portion performing the application mode during a first period after initial start-up until passage of a predetermined period, and performing the standby mode during a second period after passage of the first period until passage of a predetermined period, and the fixing device includes a surface roughness sensing portion that senses surface roughness of the outer circumferential face of the first fixing member, and the control portion reduces the application current as the surface roughness sensed by the surface roughness sensing portion increases.

8. The fixing device according to claim 7, wherein the control portion reduces the application current as periods change from a first period, in which the surface roughness increases from a state during the initial start-up to a predetermined state, to the second period, in which the surface roughness further increases from a state after the passage of the first period to a predetermined state, and then to a third period in which the surface roughness further increases from a state after a passage of the second period.

9. The fixing device according to claim 7, wherein, when the application currents after the passage of the first, second, and third periods are referred to as first, second, and third application currents respectively, the second application current is equal to or larger than $4/7$ times but smaller than $6/7$ times the first application current, and the third application current is equal to or larger than $1/7$ times but smaller than $4/7$ times the first application current.

10. The fixing device according to claim 8, further comprising a passed-sheet counting portion that counts a cumulative number of sheets passed which is a number of sheets passed through the nip since the initial start-up, wherein the surface roughness sensing portion calculates the surface roughness based on the cumulative number of sheets passed.

11. The fixing device according to claim 10, wherein, when the cumulative numbers of sheets passed after the passage of the first and second periods are referred to as a first number of sheets and a second number of sheets respectively, the second number of sheets is equal to or larger than 14 times but equal to or smaller than 18 times the first number of sheets.

12. The fixing device according to claim 7, further comprising a time counting portion that counts a cumulative driving period since the initial start-up, wherein the surface roughness sensing portion calculates the surface roughness based on the cumulative driving period.

13. The fixing device according to claim 7, further comprising a surface condition sensing mechanism that can sense surface condition of the outer circumferential face of the first fixing member, wherein the surface roughness sensing portion calculates the surface roughness based on a sensing result by the surface condition sensing mechanism.

14. A fixing device comprising:

a first fixing member that makes contact with a toner image on a sheet conveyed along a conveying passage;

a second fixing member that forms, between itself and the first fixing member, a nip through which the sheet passes;

a charging portion that generates an application current for applying electric charge so as to apply the electric charge to a part of an outer circumferential face of the first fixing member on an upstream side of the nip in a moving direction of the outer circumferential face and to the toner image on the sheet; and a control portion that controls the charging portion, wherein the control portion can perform an application mode in which the application current is generated and a standby mode in which no application current is generated, the control portion performing the application mode during a first period after initial start-up until passage of a predetermined period, and performing the standby mode during a second period after passage of the first period until passage of a predetermined period, and the fixing device includes a sheet-length sensing portion that can sense a total length of the sheet passed in the sheet conveying direction, and the control portion reduces the application current as the total length, in the sheet conveying direction, of the sheet sensed by the sheet-length sensing portion decreases.

15. The fixing device according to claim 14, wherein the control portion, when the total length of the sheet in the sheet conveying direction is larger than 220 mm, makes the application current equal to a first current and, when the total length of the sheet in the sheet conveying direction is equal to or smaller than 220 mm, makes the application current equal to a second current lower than the first current by at least 0.9 μA but not more than 1.1 μA.

16. The fixing device according to claim 14, wherein the charging portion includes a discharge electrode and a counter electrode that are arranged away from the outer circumferential face of the first fixing member, the charge portion producing corona discharge between the discharge electrode and the counter electrode to generate the application current.

* * * * *